US008578722B2

(12) United States Patent
Jakobsen et al.

(10) Patent No.: US 8,578,722 B2
(45) Date of Patent: Nov. 12, 2013

(54) CLOSED CIRCUIT VAPOUR COMPRESSION REFRIGERATION SYSTEM AND A METHOD FOR OPERATING THE SYSTEM

(75) Inventors: Arne Jakobsen, Trondheim (NO); Petter Neksa, Trondheim (NO); Sergio Girotto, Paese (IT); Havard Rekstad, Trondheim (NO); Geir Skaugen, Trondheim (NO)

(73) Assignee: Sinvent AS, Trondheim (NO)

( * ) Notice: Subject to any disclaimer, the term of this patent is extended or adjusted under 35 U.S.C. 154(b) by 647 days.

(21) Appl. No.: 12/666,449

(22) PCT Filed: Jun. 27, 2008

(86) PCT No.: PCT/NO2008/000246
§ 371 (c)(1), (2), (4) Date: Nov. 5, 2010

(87) PCT Pub. No.: WO2009/005366
PCT Pub. Date: Jan. 8, 2009

(65) Prior Publication Data
US 2011/0041527 A1 Feb. 24, 2011

(30) Foreign Application Priority Data
Jun. 29, 2007 (NO) ..... 20073356

(51) Int. Cl.
*F25B 45/00* (2006.01)

(52) U.S. Cl.
USPC ..... 62/77; 62/509

(58) Field of Classification Search
USPC ..... 62/91, 115, 509, 468, 510, 126, 129, 62/77, 200, 210, 222
See application file for complete search history.

(56) References Cited

U.S. PATENT DOCUMENTS

| | | | | |
|---|---|---|---|---|
| 5,343,935 | A * | 9/1994 | Sumitani | 165/207 |
| 6,092,379 | A | 7/2000 | Nishida et al. | |
| 6,102,114 | A * | 8/2000 | Nishihara et al. | 165/207 |
| 6,923,011 | B2 * | 8/2005 | Manole | 62/149 |
| 7,178,362 | B2 * | 2/2007 | Collings | 62/527 |

(Continued)

FOREIGN PATENT DOCUMENTS

| | | |
|---|---|---|
| CN | 1078035 A | 11/1993 |
| CN | 1209533 A | 3/1999 |

(Continued)

OTHER PUBLICATIONS

PCT/NO2008/000246 International Search Report, Nov. 7, 2008.

*Primary Examiner* — Mohammad M Ali
(74) *Attorney, Agent, or Firm* — Conley Rose, P.C.

(57) ABSTRACT

A method for operating a closed circuit vapour compression refrigeration system is disclosed. The system may operate with supercritical pressure on a high pressure side, and includes at least one compressor, at least one heat rejector, at least two in parallel connected heat absorbers, at least one variable expansion means up flow of each heat absorber and at least one control unit for controlling the variable expansion means, connected to a set of sensors. The flow rate of the refrigerant through each of the variable expansion means, is controlled by the control unit, coordinating the flow of refrigerant through each of the variable expansion means to maintain a control parameter within a set range. Any surplus charge resulting from the control is buffered on a low pressure side of the system. Furthermore a refrigeration system based on a closed vapour compression circuit is described.

18 Claims, 5 Drawing Sheets

(56) References Cited

U.S. PATENT DOCUMENTS

| | | | | |
|---|---|---|---|---|
| 7,216,498 | B2 * | 5/2007 | Manole et al. | 62/208 |
| 7,334,430 | B2 * | 2/2008 | Kakehashi et al. | 62/513 |
| 7,467,525 | B1 * | 12/2008 | Ohta et al. | 62/498 |
| 2004/0123624 | A1 | 7/2004 | Ohta et al. | |
| 2005/0132729 | A1 * | 6/2005 | Manole | 62/149 |
| 2005/0166626 | A1 * | 8/2005 | Matsumoto et al. | 62/324.1 |
| 2006/0005558 | A1 * | 1/2006 | Otake et al. | 62/260 |
| 2006/0032267 | A1 * | 2/2006 | Kamimura et al. | 62/498 |
| 2006/0137388 | A1 * | 6/2006 | Kakehashi et al. | 62/513 |
| 2006/0162377 | A1 * | 7/2006 | Collings | 62/527 |
| 2006/0218948 | A1 * | 10/2006 | Otake et al. | 62/160 |
| 2006/0254308 | A1 * | 11/2006 | Yokoyama et al. | 62/500 |
| 2007/0151270 | A1 * | 7/2007 | Matsunaga et al. | 62/216 |
| 2007/0151287 | A1 * | 7/2007 | Yahia et al. | 62/525 |
| 2007/0163293 | A1 * | 7/2007 | Ikegami et al. | 62/500 |

FOREIGN PATENT DOCUMENTS

| | | | |
|---|---|---|---|
| CN | 1463351 | A | 12/2003 |
| CN | 1734209 | A | 2/2006 |
| EP | 1757875 | A2 | 2/2007 |
| WO | 9007683 | | 7/1990 |
| WO | 9414016 | | 6/1994 |
| WO | 9727437 | | 7/1997 |
| WO | 2004057246 | A1 | 7/2004 |
| WO | 2006011789 | A1 | 2/2006 |

* cited by examiner

CLOSED CIRCUIT VAPOUR COMPRESSION REFRIGERATION SYSTEM AND A METHOD FOR OPERATING THE SYSTEM

CROSS-REFERENCE TO RELATED APPLICATIONS

This application is a 35 U.S.C. §371 national stage application of PCT Application No. PCT/NO2008/000246, filed 27 Jun. 2008, and entitled Closed Circuit Vapour Compression Refrigeration System and Method for Operating the System, hereby incorporated herein by reference, which claims priority to Norwegian Patent Application No. 2007 3356, filed 29 Jun. 2007, hereby incorporated herein by reference.

STATEMENT REGARDING FEDERALLY-SPONSORED RESEARCH OR DEVELOPMENT

Not applicable.

FIELD OF INVENTION

The present invention relates to compression refrigeration system including a compressor or a plural of compressors, a heat rejector or a plural of heat rejectors, expansion means and two or more heat absorbers, connected in a closed circulation circuit that may operate with supercritical pressure on the high pressure side, carbon dioxide or a mixture containing carbon dioxide being the preferred refrigerant in the system.

DESCRIPTION OF PRIOR ART AND BACKGROUND OF THE INVENTION

Conventional vapour compression systems reject heat at the high pressure side by condensation of the refrigerant at sub critical pressure given by the saturation pressure at the given temperature. When using a refrigerant with low critical temperature, for instance $CO_2$, the pressure at heat rejection will be supercritical if the temperature of the heat sink is high, for instance higher than the critical temperature of the refrigerant, in order to obtain efficient operation of the system. The cycle of operation will then be transcritical, for instance as known from WO 90/07683. Temperature and pressure on the high-pressure side will be independent variables contrary to conventional systems.

WO94/14016 and WO 97/27437 both describe a simple circuit for realising such a system, in basis comprising a compressor, a heat rejector, an expansion means and a heat absorber (evaporator) connected in a closed circuit. $CO_2$ is the preferred refrigerant for both of them due to environmental concerns.

The above described transcritical cycle can also be used in multi-cooling systems, for instance in a super market system, in an industrial system or in a vending machine, which typically have a plural of evaporators and compressors in parallel. In contrast to conventional systems the pressure on the high pressure side, as also described above, can be controlled independently from temperature on the high pressure side. It exists an optimum or ideal pressure on the high pressure side, with a corresponding optimum, or maximum, system efficiency for a given operation condition, as described in WO 90/07683.

Each of the evaporators in the multi cooling system may have different and varying cooling demand, and hence requires an individual control of the refrigerant supply. Each evaporator is connected to an expansion means, which control the refrigerant supply to meet the varying cooling demands. The problem is to keep the optimum pressure on the high pressure side in the overall system, and at the same time serve all the demands of the evaporators. Optimum operation of such a system will need a special control strategy.

Normally, the individual refrigerant supply is controlled by separate valves which use the evaporator refrigerant superheat as input signal or control parameter. However, superheat makes the evaporators less efficient. Reduced superheat may give liquid pulsation of the evaporator and hence an instable temperature signal and possibly cycling of the valve control. It is neither possible to maintain, e.g. an optimum high pressure control, nor control a liquid level of a receiver at an intermediate pressure level, by using this control strategy. Charge variations of the active refrigerant introduced by this control strategy must be buffered and released at an intermediate pressure level or on the high pressure side if an optimal high pressure control is to be achieved. This makes an optimal control of the pressure on the high pressure side difficult due to very high design pressure for the components that would be required. A more robust and efficient design is therefore desirable.

A further problem for larger refrigeration plants, for instance in supermarket installations, is that the evaporator supply lines may become very long. In order to save cost, it may for high pressure refrigerants, such as $CO_2$, be advantageous to switch to a lower pressure classification for the supply lines by reducing the supply refrigerant pressure. An optimized system design can ensure lower supply pressure.

WO 2004/057246 A1 describes a simple method for control of a refrigeration system that operates in transcritical mode, using for instance carbon dioxide as refrigerant. A simple and energy efficient control strategy is also needed when operating in sub-critical mode. Unlike conventional systems, only a limited part of the heat rejector will be used for condensation when using a refrigerant with a low critical temperature, for instance carbon dioxide. A new and simple method for optimum control at sub critical conditions is needed.

Evaporator coils for freezing applications (storage temperatures below 0° C.) need to be defrosted. The conventional way to perform defrosting is to supply heat by electric resistance heating rods mounted in the evaporator coil. The electric heating system increase evaporator production cost, increase running cost and increase coil size. By utilizing a proper system design, available process heat can be used for frost removal.

SUMMARY OF THE EMBODIMENTS OF THE INVENTION

A major object of the present invention is to make a simple, cost effective, energy efficient and practical system that reduces the aforementioned shortcomings and disadvantages.

The invention is characterized by the features as defined in the accompanying independent claims. Advantageous features of the invention are further defined in the accompanying dependent claims.

Accordingly, embodiments of the present invention concern a method for operating a closed circuit vapour compression refrigeration system containing a charge of refrigerant that may operate with supercritical pressure on a high pressure side. The system further includes at least one compressor, at least one heat rejector, at least two in parallel connected heat absorbers, at least one variable expansion means up flow of each heat absorber and at least one control unit for controlling the variable expansion means connected to a set of sensors. The method includes the steps of coordinated control of the flow rate of the refrigerant through each of the variable expansion means, by the control unit, to maintain a control parameter within a set range, and buffer any surplus charge, resulting from the control, on a low pressure side of the system.

The control parameter may be the pressure at the high pressure side of the system.

The control parameter may be a liquid level at intermediate pressure and the high pressure may be controlled by a separate expansion means.

Carbon dioxide or a refrigerant mixture containing carbon dioxide may be applied as the refrigerant in the system.

Surplus charge or liquid from the heat absorbers may be collected in a low pressure receiver or volume at low pressure, which also is used as buffer for a system mass balance.

The heat absorbers may be operated with a part of the refrigerant as liquid at the outlet.

The controller may collect from sensors the outlet condition of each heat absorber, and adjust the expansion means until outlet signal set points within a defined range are reached for each heat absorber.

The control signal from the liquid level indicator may be used to control the flow of refrigerant from the intermediate pressure receiver to the low pressure side of the system through an expansion means in order to keep the liquid level in the intermediate pressure receiver constant.

The pressure in the heat absorber supply lines may be reduced by extracting refrigerant vapour from the intermediate pressure vessel through a separate flow line to a main compressor, a separate compressor. The pressure in the heat absorber supply lines may be reduced by extracting refrigerant vapour from the intermediate pressure vessel to a compressor or to a lower pressure level in the system.

A two stage expansion process may be performed with a passive expansion device arrangement mounted in series with the expansion means for the heat absorbers.

The passive expansion device arrangement may have variable pressure differences according to operational conditions.

The system may have two or more low pressure levels.

Furthermore embodiments of the invention concern a refrigeration system based on a closed vapour compression circuit containing a charge of refrigerant, that may operate with supercritical pressure on a high pressure side. The system further includes at least one compressor, at least one heat rejector, at least two in parallel connected heat absorbers, at least one variable expansion means up flow of each heat absorber and at least one control unit for controlling the variable expansion means, connected to a set of sensors. A control unit is provided for coordinated control of the flow rate of the refrigerant through each of the variable expansion means to maintain a control parameter within a set range, and a volume on the low pressure side of the system is provided for buffering any surplus charge resulting from the control.

The system may include a low pressure receiver.

The low pressure receiver may include a coil through which all or a part of the high pressure fluid is flowing.

The low pressure receiver may include a line through which a part of the liquid refrigerant mixed with lubricant may be transported out of the receiver.

The system may include an internal heat exchanger.

The system may include an intermediate pressure vessel with a level indicator and a separate expansion means for controlling the pressure on the high pressure side.

The system may include a flow line from the intermediate pressure receiver to the low pressure side of the system with an expansion means that can transport liquid refrigerant or a mixture of liquid and gas refrigerant.

The system may include a flow line from the intermediate pressure receiver to the main compressor, a separate compressor or to the low pressure side of the system that can transport vapour refrigerant out of the intermediate pressure receiver.

The system may include a passive expansion device arrangement mounted in series with the expansion means for the heat absorbers.

The system may include a passive expansion device arrangement with variable pressure differential characteristic adjusted according to operational conditions.

The system may include two or more low pressure levels.

The embodiments of the present invention relate to compression refrigeration system comprising at least a compressor, a heat rejector, expansion means and two or more heat absorbers (evaporators), connected in a closed circulation circuit that may operate with supercritical pressure on the high pressure side, using for instance carbon dioxide as the refrigerant.

The embodiments of the present invention describe a novel method for control, to achieve an optimum or ideal pressure on the high pressure side, or an optimum pressure in combination with another controlled parameter, e.g. a liquid level at an intermediate pressure level in the above mentioned system. The liquid level at intermediate pressure being a level in a relatively small receiver placed down flow of a main expansion means controlling the pressure level at the high pressure side of the system. At the same time the individual refrigerant supply demands of the evaporators are satisfied. Charge variations of the active refrigerant, resulting from keeping the optimum pressure on the high pressure side, is buffered and released at the low pressure side of the system, when each of the evaporators in a multi cooling system have a different and varying cooling demand.

In a preferred embodiment, each of the cooling units or evaporators has an expansion means, which control the refrigerant supply to meet varying cooling demands. By a coordinated control of all the expansion means controlling the refrigerant supply of the different evaporators of the cooling units, it is possible to achieve for instance an optimum or ideal pressure on the high pressure side of the process. Each expansion means will be controlled by a control signal based on the conditions measured at the outlet of the evaporator. The only restriction is that that none of the evaporators should be underfed, i.e. not get sufficient supply of refrigerant. If the pressure on the high pressure side needs to be changed, all the expansion means will be controlled together in a coordinated action in order to obtain a change of the pressure, comparing control signals from the cooling units. If the control signal from one of the sensors is outside an acceptable range, the necessary adjustment of the corresponding expansion means must be satisfied by a simultaneous compensation it may be necessary to adjust of one or more of the other expansion means. This is done in order not to deviate from the optimal control of the main controlled parameter, for instance the pressure on the high pressure side of the system. In this way optimum operation is established for a system for multi-cooling purposes.

Another embodiment includes a separate valve for controlling the pressure at the high pressure side. Then to the coordinated control of the expansion means may be used to control another parameter, for instance a liquid level of a receiver at intermediate pressure.

In one embodiment, excess liquid from one or more of the evaporators will be buffered on the low pressure side in a receiver or a volume between the evaporators and the compressor.

In another embodiment, a by-pass between the possible intermediate pressure vessel and the low pressure side may allow liquid refrigerant or a mixture of liquid refrigerant and vapour refrigerant to be transferred to the low pressure side, in order to simplify the control of the individual expansion means controlling the feed of refrigerant to the different evaporators.

The control principle is developed for several system designs and for several applications. Examples of applications are supermarket refrigeration, industrial system and vending machines.

BRIEF DESCRIPTION OF THE DRAWINGS

The invention will be further described in the following by way of examples only and with reference to the drawings in which.

DETAILED DESCRIPTION OF EMBODIMENTS OF THE INVENTION

Figure 1:
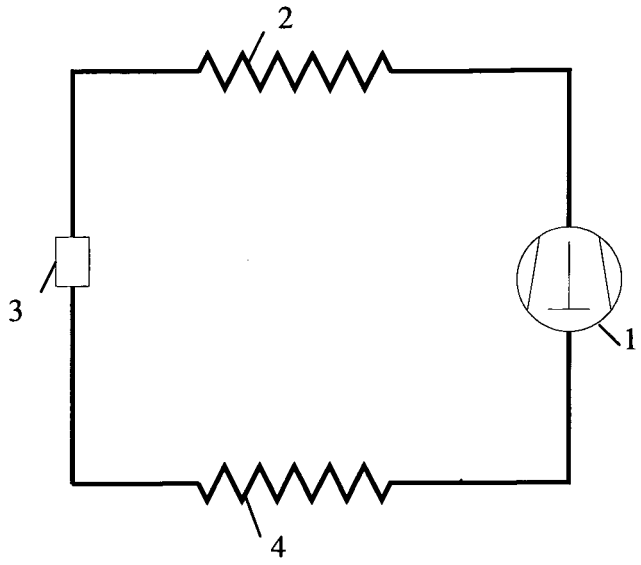
FIG. 1 illustrates a simple circuit for a vapour compression system.

FIG. 1 illustrates a conventional vapour compression system comprising a compressor 1, a heat rejector 2, an expansion means 3 and a heat absorber 4 connected in a closed circulation system.

Figure 2:
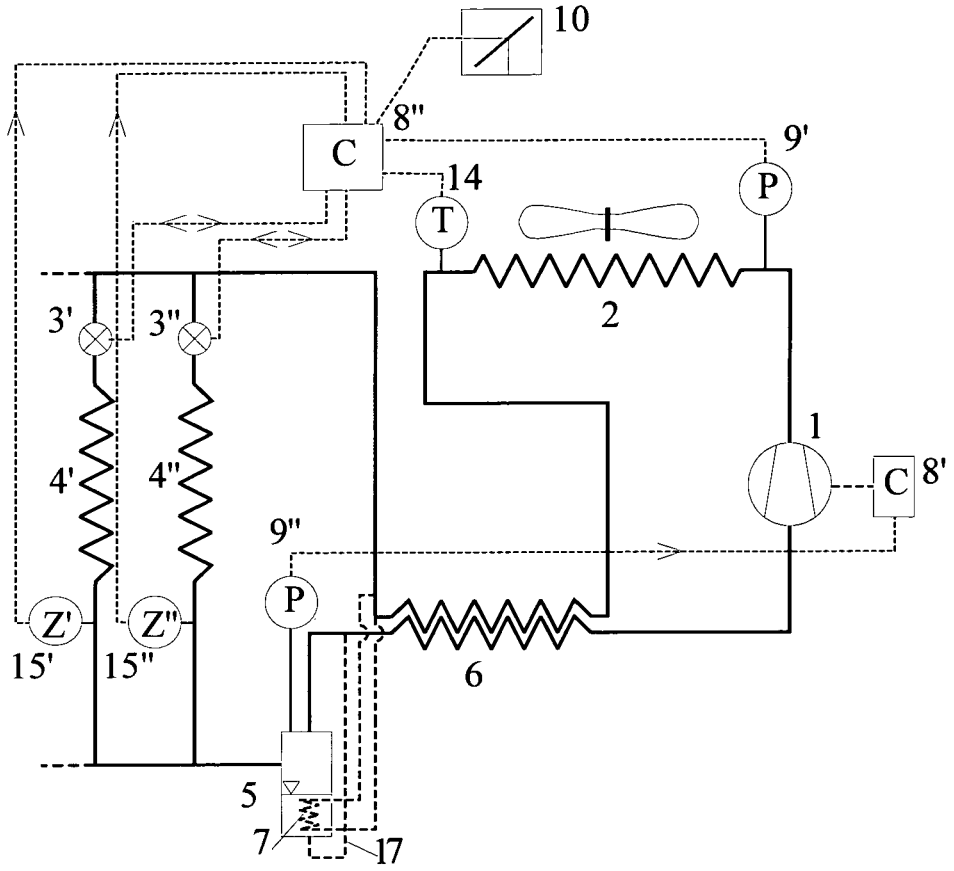
FIG. 2 illustrates a system solution and a control system for a multi heat absorber system.

FIG. 2 shows a one stage vapour compression system with two or more heat absorbers (evaporators) 4', 4" in parallel. The system also contains a low pressure receiver 5, an internal heat exchanger 6, a compressor 1, a gascooler 2, a temperature sensor 14, pressure sensors 9', 9", and sensors 15', 15", for detecting the outlet condition from the heat absorbers (evaporators). Signals transmitted from the sensors 14, 15', 15", 9', 9", reflecting the operational conditions of the system are sent to a control system 8', 8". The control systems 8', 8"controls respectively compressor capacity and the expansion means 3', 3" respectively, for controlling refrigerant feed to the heat absorbers.

The control systems 8', 8" receives input signal from the temperature sensor 14, input signal from the sensors 15', 15", at the outlet of the heat absorbers, and input signal from the pressure sensors 9', 9" at high and low pressure sides of the compressor 1 respectively. The input signal from the pressure sensor 9' may reflect the pressure on the high pressure side of the system, while the pressure sensor 9" monitors the pressure on the low pressure side. The control systems 8', 8" may also be only one control system or more separate control systems, e.g. control system for each expansion means or controlled component, as long as it serves to control the described parameters.

The temperature sensor 14, producing a signal to the control system 8", may measure a temperature reflecting the ambient conditions. The sensor may also measure e.g. the gascooler outlet temperature or another parameter important for identifying the ideal or optimal pressure.

Based on the received signals, the control 8" unit can feed control input to the expansion means 3', 3", to control pressure drop and flow rate through the expansion means 3', 3".

The control system may use different strategies or algorithms to perform the control. One such algorithm is schematically represented by curve 10. Alternatively, or in addition, the control system may include an adaptive online system.

The control system 8" can, based on the above, ensure optimal operating conditions through individual control of the expansion means 3', 3". By a coordinated control of all the expansion means 3', 3", controlling the refrigerant supply of the different cooling units, it is possible to control, with the control system 8", for instance an optimum high pressure of the process, and at the same time ensures sufficient feeding of the individual evaporators 4.

The system of FIG. 2 can be used for one stage expansion as explained below. The pressure on the high pressure side should be controlled along with the control of the refrigerant supply to the evaporators 4', 4". For each of the evaporators 4', 4" (or plurality of evaporators) the refrigerant feeding or supply is controlled by the expansion means 3', 3".

If the pressure on the high pressure side needs to be changed as a result of a deviation from one of the defined values 10, e.g. as a result of a change of the ambient conditions, this will be registered by the temperature sensor 14, and an altered signal will be sent to the control system 8". As a result, the control system, 8", will supply a signal to the expansion means 3', 3" such that these means 3', 3"will be controlled simultaneously in a coordinated action to obtain a change of the pressure on the high pressure side. If the control signal to one of the expansion means 3', 3" results in an outlet condition measured by sensors 15', 15", that is outside a predetermined range, the adjustment of this expansion means must be compensated by a simultaneous adjustment of one or more of the other expansion means in order not to deviate from the optimal control of the main controlled parameter, for instance the high pressure. In this way, optimum operation is established for a system for multi-cooling purposes and it is at the same time possible to operate the evaporators 4', 4" with different conditions at the outlet, e.g. with superheat, wet or saturated.

Excess liquid from one or more of the evaporators 4', 4", resulting from the described control concept or algorithm, will be buffered on the low pressure side in a receiver 5 or a volume between the evaporators and the compressor. The volume 5 may be an integral part of the flow lines. In this way the system can accept wet outlet from one or more of the cooling units 4', 4", which may be a result of the control concept. This is contrary to common systems requiring a superheated outlet from all the evaporators. The result is also that a wide range of signals can be accepted from the sensors 15', 15". The control unit 8" only needs to compensate between the different expansion means 3', 3", if the sensors 15', 15" detect an unacceptable high superheat out of one of the evaporators 4', 4". A too high superheat, resulting from under-feeding the evaporator due to a too low mass flow of refrigerant, would reduce both capacity of the cooling unit and result in unacceptable energy efficiency of the system.

If the pressure on the high pressure side is too high, one or more of the expansion means 3' 3" will be adjusted to give increased mass flow rate, and this pressure will be reduced. Since the pressure difference in the system has changed, the mass flow through the evaporators 4', 4" will be affected. The expansion means 3', 3" will then be adjusted by the control system 8" to give accepted set values for the conditions or properties at the evaporator outlet measured by the sensors Z', Z" 15', 15", which again may affect the pressure difference in the system. In order to reach set values for both this pressure and acceptable fluid properties out of the evaporator, the control system 8", may have to repeat the adjustment process, giving a control loop. When all the set points are reached, mass has been transported from the high pressure side to the low pressure side, and excess refrigerant is accumulated in the receiver, 5.

If the pressure on the high pressure side becomes too low, then one or more of the expansion means 3', 3" will be adjusted to reduce the mass flow. Pressure at the high pressure side will increase. Simultaneously, the evaporator outlet condition(s) will change, either by a reaching a higher vapour quality or a super heat of higher degree. The pressure at the low pressure side of the system may also be reduced. Both of the above mentioned effects contribute to a boil off of liquid in the low pressure receiver 5. Mass will be transported to the high pressure side, thus increasing the pressure at this side even more. Since the pressure difference in the system has changed in this way, the mass flow through the evaporators 4', 4" will be affected. The expansion means 3', 3" will then be adjusted by the control system 8" to give acceptable set values for the outlet conditions from the evaporators 4' 4", measured by the sensors 15, 15", which again may affect the pressure difference in the system. In order to reach set values for both the pressure on the high pressure side and the conditions at the evaporator outlet, the control system 8" may have to repeat the adjustment process, giving a control loop. The low pressure in the system, possibly measured with a pressure sensor 9", will typically be separately controlled by controlling the compressors with a control unit 8'.

The internal heat exchanger 6 shown in FIG. 2 is not absolutely necessary for the system to work, but will most often improve efficiency and the general operation of the system. It will also serve to evaporate some or all of the liquid introduced at the low pressure entrance of the heat exchanger before entering the compressor 1. At the same time the internal heat exchanger will contribute to sub-cool the fluid at the high pressure side before expansion in the expansion means 3', 3". Another way of handling liquid in the suction line before the compressor 1, would be to use a compressor that accepts liquid suction.

In connection with the internal heat exchanger 6, a tube 17 can be installed to suck out lubricant, liquid refrigerant or a mixture of these. The refrigerant liquid transport out of the low pressure receiver 5 will determine the mean vapour quality out of the evaporators 4', 4".

By introducing a coil 7 inside the low pressure receiver 5, further sub-cooling of the high pressure fluid can be achieved, and more liquid will be boiled off in the low pressure receiver 5. The coil 7 can either be designed for full high pressure flow, or for a split stream as indicated in FIG. 2. The more liquid boiled off in the low pressure receiver 5, the lower the mean vapour quality of the refrigerant flowing out of the evaporators 4', 4" will be. Lower vapour quality in this context means a higher liquid content, according to the mass balance at steady state operation.

Two-Stage Throttling

The control principle described above implies that the pipes feeding the evaporators must withstand the high pressure all the way to the evaporators 4', 4". This may be disadvantageous if the pipes are long, for instance in supermarkets. It also requires evaporator throttling valves to withstand the high pressure. Special designed high pressure valves will probably be more expensive.

Figure 3:
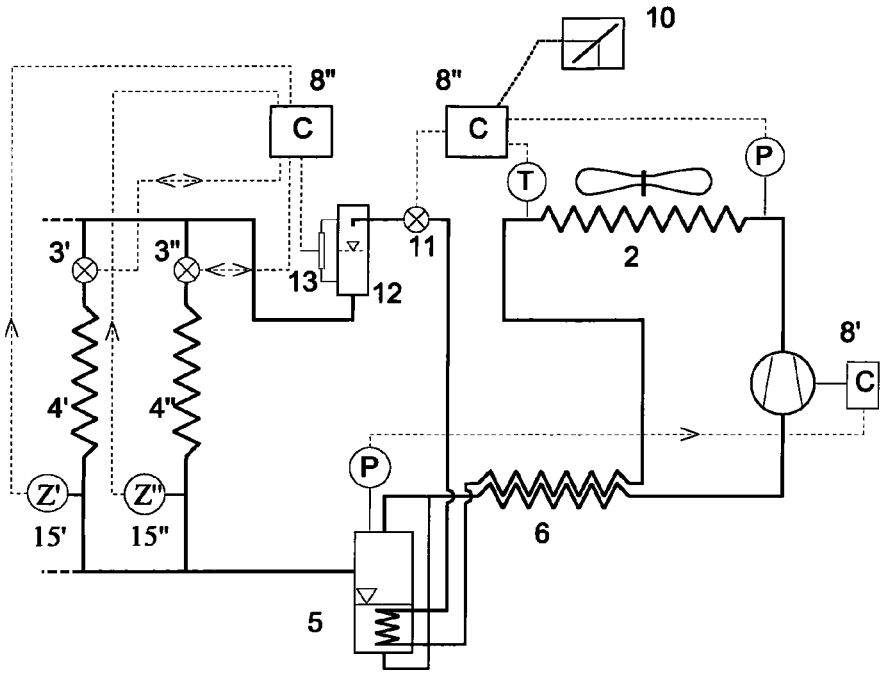
FIG. 3 illustrates a system solution and a control system for a multi heat absorber system with an intermediate pressure receiver for a two stage throttling process allowing refrigerant distribution at intermediate pressure.

FIG. 3 shows a principle similar to the one described above, but with a two stage throttling system. Additional components are a high pressure expansion means 11, a receiver 12, liquid level detector 13 which detects a liquid level in the receiver 12 and a level detector 13. The controller 8" is controlling the expansion means 3', 3" based on the signals from the sensors 15', 15" and the level detector 13.

One main expansion means 11 is controlled by the controlling unit 8" to adjust the high pressure in the system. As indicated above, the optimum high side pressure can be achieved with different control strategies. One control strategy can for instance be related to a predetermined curve 10 based on calculations or experience, or an adaptive online system.

The outlet flow of the expansion means 11 is led to an intermediate pressure receiver 12. Medium pressure liquid can then be distributed to the evaporators 4', 4" through the expansion means 3', 3". In order to store only a small volume of refrigerant at the intermediate pressure, the receiver 12 is not designed to handle charge variations. The expansion means 3', 3" are instead controlled simultaneously in a coordinated action by the controller 8" to keep a constant liquid level in receiver 12.

If the control signal to one of the expansion means 3', 3" results in an outlet condition measured by sensors 15', 15", that is outside a predetermined range, the adjustment of this expansion means must be compensated by a simultaneous adjustment of one or more of the other expansion means 3', 3", in order not to deviate from the optimal control of the main controlled parameter, in this case the liquid level of receiver 12, detected by liquid level detector 13.

Variation in different parameters may induce a change in the liquid level of the intermediate pressure receiver 12, e.g. control of the high pressure by the expansion means 11. This will have to be compensated by the controller 8" by simultaneous adjustment of one or more of the expansion means 3', 3" controlling the flow to the evaporators 4', 4".

The capacity control of each of the evaporators will in principle be identical to the control described above. Each expansion mean 3', 3" will be adjusted to keep the evaporator outlet conditions detected by the sensors 15', 15", within acceptable values. These adjustments will also affect the liquid level in the intermediate pressure receiver 12, and the controller 8" may have to repeat the adjustment of the liquid level in the receiver 12, giving a control loop.

If the liquid level in the intermediate pressure receiver 12 is detected by the liquid level detector 13 to be too high, one or more of the expansion means 3', 3" will be adjusted to give increased flow rate. Liquid level will be reduced. When the liquid level set point is reached, the expansion means 3', 3" will then be adjusted by the control system to give set values for the evaporator 4 outlet conditions. Refrigerant mass has been transported from the intermediate pressure vessel 12 to the low pressure receiver 5, where possible excess liquid is accumulated.

If the liquid level becomes too low, then one or more of the expansion means 3', 3", will be adjusted to reduce the flow rate. Liquid level will increase.

Simultaneously, the evaporator outlet conditions, detected by the sensors 15', 15", may become (more) superheated, and the low pressure in the system may also be reduced. Both effects contribute to a boil off of liquid in the low pressure receiver 5. Refrigerant mass will be transported to the high pressure side, thus increasing the high pressure. The main expansion means 11 will then increase the opening in order to maintain the set point pressure given by the optimal curve 10. More liquid will be produced in the expansion process into the intermediate pressure vessel 12, and the liquid level will increase further. When the set point value of the liquid level is reached, one or more of the expansion means 3', 3" will be adjusted to increase the flow rate. In order to reach set point values for all the evaporator 4', 4" outlet conditions detected by 15', 15", high side pressure and the liquid level in the intermediate pressure receiver 12, the control system may have to repeat the adjustment process, giving a control loop.

The intermediate pressure vessel 12 can be made with a relatively small volume and thus saving cost. It is not required to buffer varying amounts of refrigerant.

In the two-stage throttling process described above, vapour is not sucked out of the intermediate pressure vessel 12. By definition, the state in the intermediate pressure receiver 12 will always be on the liquid saturation line. The pressure in this receiver will hence be defined by the inlet condition of the main expansion means 11. If a lower pressure in the intermediate pressure receiver 12 is desired, vapour needs to be transported out of the receiver 12. This can be done either directly by a compressor, probably convenient for larger systems, or the vapour can be expanded down to the low pressure side through a flow line, not shown in FIG. 3, controlled by an expansion means.

The intermediate pressure can be controlled by varying the vapour outlet flow. It can hence e.g. be controlled to be 40 bar independently of the high pressure in the system. This will open for use of standard components in the evaporator systems.

Since the vapour is saturated in the vessel 12, an expansion process of the vapour to the low pressure side will produce liquid, which preferably should be removed from the flow before entering the compressor. One option is to expand the vapour flow down to the suction line before the internal heat exchanger 6 for liquid boil off in heat exchange with the high pressure fluid. Another option is expansion down to the low pressure receiver 5.

Figure 4:
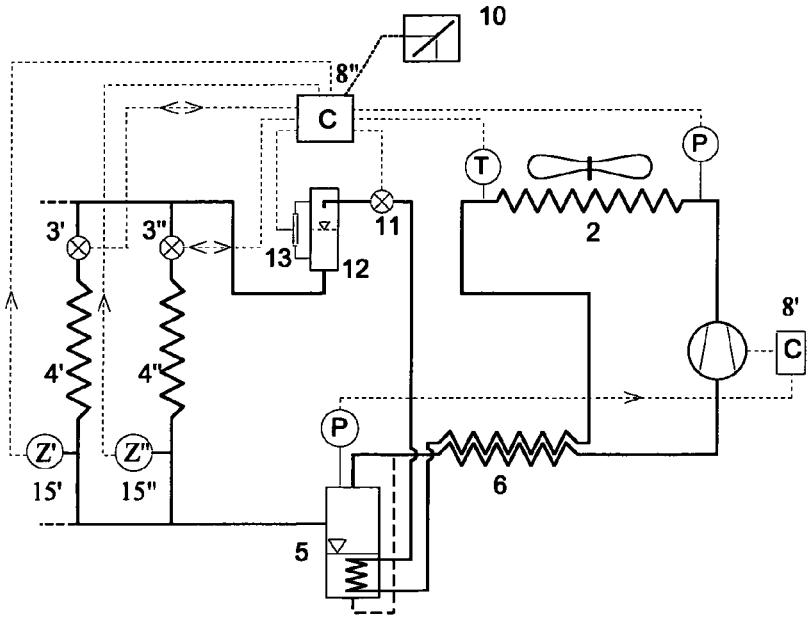
FIG. 4 illustrates a system solution and a control system for a multi heat absorber system with an intermediate pressure receiver for a two stage throttling process allowing refrigerant distribution at intermediate pressure with possibilities for a separate refrigerant by-pass from the intermediate pressure receiver to the low pressure of the system.

FIG. 4 shows a principle similar to the one described above, with a two stage throttling system, but an additional expansion means 16 is included. The additional expansion means 16 is controlling flow of refrigerant, liquid or a mixture of liquid and vapour, from the intermediate pressure receiver 12 to the low pressure side of the system, e.g. to the low pressure receiver 5. The controller 8" is controlling the expansion means 16 by the signal given by the level indicator 13, in order to keep the level in the intermediate pressure receiver 12 constant. A direct mechanical or electronic control of the expansion means 16 by the level detector 13 will also be possible. The expansion means 3', 3" can now be controlled by the controller 8" to feed the evaporators 4 based on the signals from the sensors 15', 15". The signal set point of the sensors 15', 15" can now be e.g. a defined superheat signal, since the possible liquid that might start to accumulate in the intermediate pressure receiver 12 can be by-passed to the low pressure side through expansion means 16. This may also allow a direct mechanical or electronic control of the expansion means 3', 3" by sensors 15', 15", e.g. being refrigerant filled bulbs as commonly used in thermostatic expansion valves.

Also for this solution, it can be favourable to reduce the pressure in the intermediate pressure receiver 12 by transporting vapour out of the receiver 12, either directly by a compressor, probably convenient for larger systems, or the vapour can be expanded down to the low pressure side through a flow line, not shown in FIG. 4, controlled by an expansion means.

Figure 5:
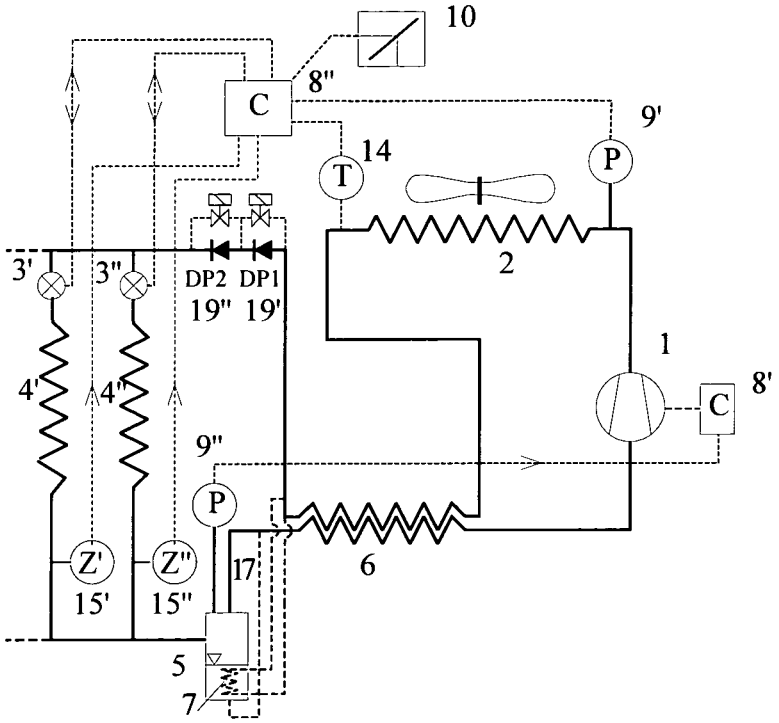
FIG. 5 illustrates a system solution and a control system for a multi heat absorber system with a two stage throttling process allowing refrigerant distribution at intermediate pressure, without the use of an intermediate pressure receiver.

Two Stage Throttling without Intermediate Pressure Receiver:

The two stage throttling process described above requires a more advanced control system than the one shown in FIG. 2, and an intermediate pressure receiver is also required. A simpler system will be to use a two stage throttling system without intermediate pressure receiver. FIG. 5 shows a principal drawing. In addition to the components described for FIG. 2, the system contains one or more of the expansion means 19', 19". Since there is no buffer volume between the two expansion steps, hence performed by the expansion means 19', 19" and the expansion means 3', 3", one of the expansion steps needs to be passive. Due to the capacity control of the evaporators 4', 4", the passive expansion mean should preferably be the first expansion step performed by the expansion means 19', 19". This can for instance be a constant differential pressure (DP) valve. By using the control principle as described for the system represented by FIG. 2 for control of the flow rate to the evaporators 4', 4", the high pressure will indirectly be controlled by the evaporator expansion means 3', 3" of the evaporators 4', 4".

No liquid gas separation at intermediate pressure, upstream of the expansion means 3', 3", will occur in this system. Hence no vapour can by sucked out to control the intermediate pressure. Intermediate pressure is controlled by the pressure difference of the expansion means 19', 19". If there are requirements for the intermediate pressure level, for instance never to exceed 45 bar, then a more sophisticated expansion means arrangement might be required. A possibility can be to put two or more expansion means with different differential pressure values in series with bypasses, as indicated in FIG. 5 by 19', 19". By changing the active DP expansion means, a proper intermediate pressure can be achieved.

Systems with Two Low Pressure Levels

The above described control principle can be applied to systems with one low pressure level. The required low pressure level(s) may vary dependent on the application, for instance cooling and freezing applications.

Figure 6:
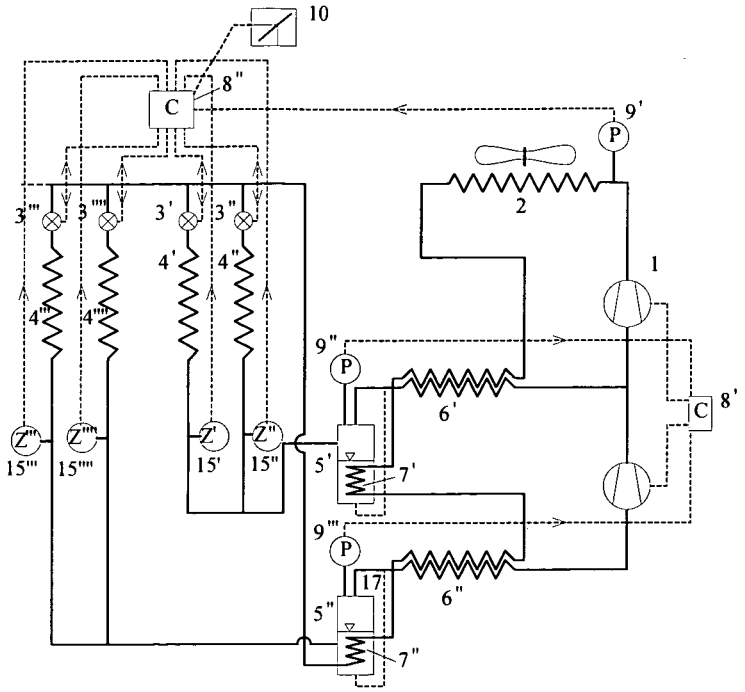
FIG. 6 illustrates a system solution and a control system for a multi heat absorber system with two different pressure levels for the heat absorption.

FIG. 6 illustrates the same control principle as described by FIG. 2 for a system working at two different low pressure levels using a common gascooler 2. Other components with corresponding reference numbers as in FIG. 2 is shown. FIG. 6 shows one example of a compressor and gascooler arrangement. Several other arrangements are possible.

The invention claimed is:

1. A method for operating a closed circuit vapor compression refrigeration system containing a charge of refrigerant in an expansion process with at least two pressure level stages, the method comprising:

providing the closed circuit vapor compression refrigeration system having a high pressure side, an intermediate pressure level, and a low pressure side, the system further including:

a compressor;

a heat rejector;

a first heat absorber;

a second heat absorber arranged in parallel with the first heat absorber;

a first variable expansion member upstream of the first heat absorber and a second variable expansion member upstream of the second heat absorber;

an intermediate pressure receiver;

a level detector configured to measure a liquid level in the intermediate pressure receiver;

a third expansion member; and a control unit for controlling the first variable expansion member and the second variable expansion member, wherein the control unit is coupled to a plurality of sensors disposed along the system; and controlling flow of the refrigerant through the first variable expansion member and the second variable expansion member in a coordinated fashion with the control unit to maintain a control parameter within a set range, and buffer any surplus charge, resulting from the controlling on the low pressure side of the system;

wherein the control parameter is the liquid level measured by the liquid level detector, and wherein a pressure of the intermediate pressure receiver and the high pressure side is controlled by the third expansion member.

2. The method according to claim 1, wherein the charge of refrigerant comprises carbon dioxide or a mixture containing carbon dioxide.

3. The method according to claim 1, further comprising collecting the surplus charge from the first heat absorber and the second heat absorber in a low pressure receiver at low pressure, and using the low pressure receiver as a buffer for a system mass balance.

4. The method according to claim 1, wherein the heat absorbers are operated with a part of the refrigerant as liquid at the outlet of the heat absorbers.

5. The method according to claim 1, wherein the plurality of sensors comprises a first sensor and a second sensor;

wherein the first sensor obtains a first measurement of an outlet condition of the refrigerant downstream of the first heat absorber and the second sensor obtains a second measurement of an outlet condition of the refrigerant downstream of the second heat absorber; and wherein controlling flow of the refrigerant through the first variable expansion member and the second variable expansion member comprises:

collecting the first measurement and the second measurement with the control unit ; and adjusting the first expansion member and the second expansion member to bring the first and second measurements within a defined range.

6. The method according to claim 1, wherein controlling the flow of the refrigerant through the first variable expansion member and the second variable expansion member comprises:

collecting a signal from the liquid level detector;

controlling the flow of refrigerant from the intermediate pressure receiver to the low pressure side of the system through the first variable expansion member and the second variable expansion member based on the signal to keep the liquid level in the intermediate pressure receiver constant.

7. The method according to claim 1, further comprising reducing a pressure upstream of the first heat absorber and the second heat absorber by extracting refrigerant vapor from the intermediate pressure receiver through a separate flow line to the compressor, a separate compressor, or to a lower pressure level in the system.

8. The method according to claim 1, wherein the system includes two or more low pressure levels.

9. The method of claim 1, further comprising operating the closed circuit vapor compression refrigeration system with a supercritical pressure on the high pressure side of the system.

10. A refrigeration system based on a closed vapor compression circuit containing a charge of refrigerant in an expansion process with at least two pressure level stages, the system comprising:

a high pressure side, an intermediate pressure level, and a low pressure side;

a compressor;

a heat rejector;

a first heat absorber;

a second heat absorber arranged in parallel to the first heat absorber;

a first variable expansion member upstream of the first heat absorber and a second variable expansion member upstream of the second heat absorber;

an intermediate pressure receiver;

a level detector configured to measure a liquid level in the intermediate pressure receiver;

a third expansion member configured to control the pressure on the high pressure side;

a control unit coupled to a plurality of sensors disposed along the system, wherein the control unit is configured to control the flow of the refrigerant through the first variable expansion member and the second variable expansion member to maintain a control parameter within a set range; and a volume disposed at the low pressure side of the system for buffering any surplus charge resulting from the control by the control unit.

11. The refrigeration system according to claim 10, comprising a low pressure receiver.

12. The refrigeration system according to claim 11, wherein the low pressure receiver comprises a coil configured to receive at least a portion of the refrigerant within the high pressure side.

13. The refrigeration system according to claim 11, wherein the low pressure receiver comprises a line configured to transport a part of the liquid refrigerant mixed with lubricant out of the low pressure receiver.

14. The refrigeration system according to claim 10, comprising an internal heat exchanger.

15. The refrigeration system according to claim 10, comprising a flow line from the intermediate pressure receiver to the low pressure side of the system with a fourth expansion member configured to transport liquid refrigerant or a mixture of liquid and gas refrigerant.

16. The refrigeration system according to claim 10, comprising a flow line from the intermediate pressure receiver to the compressor, a separate compressor, or the low pressure side of the system configured to transport vapor refrigerant out of the intermediate pressure receiver.

17. The refrigeration system according to claim 10, wherein the system has two or more low pressure levels.

18. The refrigeration system of claim 10, wherein the closed circuit vapor compression refrigeration system is configured to operate with a supercritical pressure on the higher pressure side of the system.

* * * * *

UNITED STATES PATENT AND TRADEMARK OFFICE

CERTIFICATE OF CORRECTION

PATENT NO. : 8,578,722 B2
APPLICATION NO. : 12/666449
DATED : November 12, 2013
INVENTOR(S) : Jakobsen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 959 days.

Signed and Sealed this
Twenty-second Day of September, 2015

Michelle K. Lee

Michelle K. Lee
*Director of the United States Patent and Trademark Office*